United States Patent [19]

Buchholz

[11] Patent Number: 4,613,397

[45] Date of Patent: Sep. 23, 1986

[54] EQUIPMENT FOR APPLYING A BLANK OF FOIL TO BOTTLES

[75] Inventor: Rainer Buchholz, Dusseldorf, Fed. Rep. of Germany

[73] Assignee: Jagenberg AG, Dusseldorf, Fed. Rep. of Germany

[21] Appl. No.: 672,447

[22] Filed: Nov. 16, 1984

[30] Foreign Application Priority Data

Dec. 14, 1983 [DE] Fed. Rep. of Germany ..... 3345226

[51] Int. Cl.[4] ..... B65C 3/22; B65C 9/02

[52] U.S. Cl. ..... 156/476; 156/488; 156/493; 156/567; 156/DIG. 16; 156/DIG. 25; 156/DIG. 42

[58] Field of Search ..... 156/477.1, 488, 493, 156/567, 568, DIG. 16, DIG. 25, DIG. 42, 476

[56] References Cited

U.S. PATENT DOCUMENTS 4,025,067 5/1977 Schlacht ..... 156/568
4,230,518 10/1980 Fahnrich ..... 156/488
4,536,247 8/1985 Buchholz et al. ..... 156/488

FOREIGN PATENT DOCUMENTS 3104807 7/1982 Fed. Rep. of Germany .

*Primary Examiner*—Michael Wityshyn
*Attorney, Agent, or Firm*—Sprung Horn Kramer & Woods

[57] ABSTRACT

In equipment that is intended for applying a blank of foil to bottles and that includes a turntable, at least one labeling station, a rotating transport star that has accommodations for the bottles and is positioned downstream of the turntable, and a rotating transfer-and-application device consisting of several similar units distributed around its circumference with elements that fold and press down the ends of the blank extending beyond the head of each bottle, the pressure-application elements and if necessary the folding elements are, as they revolve, kept outside the circumference of the elements on the turntable that accommodate the bottle. This avoids collisions at this point. The axis of rotation of the pressure-application elements and the axis of rotation of the output star are accordingly mutually eccentric in such a way that the orbits of the accommodations and of the pressure-application elements coincide along one segment. The equipment will not malfunction and will ensure satisfactory bottle foiling.

23 Claims, 10 Drawing Figures

EQUIPMENT FOR APPLYING A BLANK OF FOIL TO BOTTLES

BACKGROUND OF THE INVENTION

The present invention relates to equipment that is intended for applying a blank of foil to bottles and that includes a turntable with several separately controlled devices around its circumference for rotating the bottles, at least one labeling station for transferring the foil blanks (and other labels if desired) to the bottles once the rotation devices have positioned the bottles at a specific angle, an application device that presses the blanks (or other labels) onto the bottles, a rotating transport star that has accommodations 11 for the bottles and is positioned downstream of the turntable and upstream of a conveyor belt that carries the bottles away, and a supporting stand that is positioned in the vicinity of the star and has a rotating transfer-and-application device consisting of several similar units distributed around its circumference with elements that fold and press down the ends of the blank extending beyond the head of each bottle.

Every unit in the equipment for applying a blank of foil to bottles that is known from German Offenlegungsschrift 3 104 807 can, as the transport star rotates be pivoted from one position beside its associated bottle accommodation into another position above the associated accommodation and axially lowered in the second position against the head of a bottle that is secured in the accommodation. The folding element in each unit consists of a wrapping mechanism and the pressing element of a pressure-application head that is positioned downstream of it along the direction of pivot out of the first and into the second position and that surrounds the head of the bottle on all sides as it is lowered. Folding and pressing elements of this type are completely appropriate for what is called corner foiling, in which square blanks are applied to the neck and head of a bottle in such a way that one corner of the blank extends down and one corner up and beyond the head of the bottle. When, however, what is called round foiling, in which a rectangular blank is applied in a horizontal position around an upright bottle, is desired, the end of the foil that extends up like a sleeve beyond the head of the bottle can only be wrapped around the head by folding it down from one side and then wrapping it around the head from the other side. Each unit in the known equipment is accordingly pivoted out of its initial position into a third position facing both the first and the second position and provided with an additional wrapping mechanism that has the same radial dimensions as the sleeve-like projecting end of the the blank. Since the folding and pressure-application elements in the known equipment are thus combined into one subassembly, it would be highly desirable to optimize the folding-in process, specifically both preliminary and final folding, along with the process of pressing down the blank. Since the units in the known equipment are articulated to the supporting stand in such a way as to arrive, as they revolve along with the folding and pressure-application elements, at the points on the turntable determined by the rotation devices on the turntable, the breakage or tilting of a bottle in the area of engagement between the turntable or a centering hood associated with it and the folding and pressure-application elements can lead to jamming and operational malfunction, especially bending of and/or damage to the pressure-application elements, impeding the unobjectionable application of the foil. This is a special drawback because the pressure-application head is combined as mentioned in the foregoing with the folding elements. The requisite vertical motion and simultaneous control of the pivoting motion of the pressure-application elements along with the comparatively high number of pressure-application heads, which must equal the number of accommodations in the transport star, makes the equipment very expensive, the more so in that the supporting stand and output star must be driven in conjunction, so that, when the folding and pressure-application elements are changed, and hence the supporting stand re-adapted, the output star must also be replaced.

SUMMARY OF THE INVENTION

The object of the present invention is to provide equipment of the aforesaid type that will be inexpensive to manufacture, that will not malfunction as the result of jamming between the turntable and the folding and pressure-application elements on the supporting stand, and that will ensure satisfactory bottle foiling in conjunction with the intended type of preliminary or final folding.

This object is attained in accordance with the invention in that the pressure-application elements 33 and if necessary the folding elements 61 and 63 are, as they revolve, kept outside the circumference of the elements on the turntable that accommodate the bottles 1. This prevents any collision between the two rotating systems, specifically the turntable and the pressure-application elements.

To prevent foil-head folding-in from interfering in the turntable while retaining satisfactory foiling, special care must be devoted to the position of the stand 26 that supports the folding and pressure-application elements in relation to the turntable and the output star. It has been discovered that these conditions can be satisfied very effectively if the axis 32 of rotation of the pressure-application elements 33 and the axis 29 of rotation of the output star 10 are eccentric.

In accordance with another motive basic to the invention care must be taken to ensure that the amount of eccentricity between the two axes of rotation and the radial distances of the accommodations in the transport star from its axis of rotation and of the pressure-application elements from their axis of rotation are selected to ensure that the orbits of the accommodations and of the pressure-application elements extensively coincide along one segment 34. Since the interval between adjacent pocket-shaped accommodations in the transport star 10 and between adjacent pressure-application elements is always identical, peripheral speeds will always be identical within the segment. This common path can be exploited for example for pressing down the blanks after their projecting ends have been folded in.

It is advantageous for the common section of the orbits to be located in the vicinity of the conveyor belt 13 that carries the bottles away. The sequence of motions and the flexibility of the transport star allow any slight variations in the segment common to both orbits to be compensated. The advancing motion of the conveyor belt ensures a defined sliding motion on the part of the bottles and hence unobjectionable transport.

The eccentricity of the axis of rotation of the pressure-application elements in relation to that of the transport star allows the number of pressure-application elements and of folding elements 63 if any to be lower than that of the accommodations 11 in the second transport star 10. This makes the equipment considerably less expensive to manufacture while allowing complete exploitation of the intervals for the pressure-application heads because, since it will no longer be necessary to take the centering-head components of the hood 14 on the turntable 7 into account, the pressure-application elements can be larger than heretofore, which contributes to satisfactory foiling.

In accordance with another characteristic of the invention, the mechanism that drives the pressure-application elements and the folding elements 63 if any is separate from the mechanism that drives the second transport star 10. The conventional coupling between the supporting stand 26 and the transport star is accordingly no longer necessary, which considerably simplifies converting to a different bottle format because the design of the first transport star does not have to be taken into consideration, which also entails the advantage that the novel folding and pressure-application elements in accordance with the invention can easily be installed in existing machines without other structural changes if the drive mechanism is ignored.

The mechanism that drives the pressure-application elements and folding elements if any can be a reversing gear train 35 alongside the second transport star 10. The reversing gear train 35 can have, for example, a driveshaft 39 that extends through a housing flange 42 on the supporting stand 26 and mutually meshing cogwheels 36, 37, and 38 mounted on a supporting plate 27 that extends over the second transport star 10. The housing flange can have a level adjustor 43 to control the height of the supporting stand 26. A bearing housing 45 accommodating a bearing shaft 46 that secures a retainer plate 47 on which the pressure-application elements 33 are mounted is in a practical way mounted concentric to the axis 32 of rotation of the pressure device 28 on the side of the supporting plate that faces away from the cogwheels.

The pressure-application elements and the folding elements if any are mounted on the side of the retainer plate that faces the second transport star and sleeves 48 that spring-loaded drag rods 49 for the pressure-application elements slide up and down inside of are mounted on the side of the retainer plate that faces the supporting plate.

It is important for the axis of the drag rods to coincide with the axes of the pressure-application elements. This eliminates potential tilting moments on the bottles and ensures satisfactory and unobjectionable application of the blanks of foil.

It is especially important to the present invention for support rollers 51 that project out laterally and operate in conjunction with a contour 52 on a pot-shaped wall 53 of the bearing housing 45 in order to move the pressure-application elements vertically to be mounted in the sleeves. The equipment in accordance with the invention requires, in contrast to previous types of equipment, the pressure-application elements to move only vertically, resulting in a further simplification of the design.

This is especially true when the pressure-application elements are also folding elements. This can be done by simply making the projecting ends of the blank travel beyond the bottom of the pressure-application element while the pressure-application device revolves, so that special folding elements will not be necessary.

It is, of course, also within the scope of the invention for the pressure-application elements to be separate from the folding elements 61 and 63. In this case, the folding elements can have preliminary-folding components 61. The preliminary-folding components are for example positioned radially around a common shaft 59 that meshes through a cogwheel 57 with the cogwheels 36 in the reversing gear train that drives the bearing shaft. In one variant of the invention the folding elements are pivoting arms 63 guided by a contour system 66, 67, and 71. The contour system is designed in such a way that the pivoting arms, which are equipped with a nose 65, also function as preliminary and final folding mechanisms. This is attained by having one pivoting arm carrying out the preliminary folding for one bottle and then carrying out the final folding for the adjacent upstream bottle, with the pivoting arm always traveling at a higher speed than that at which the bottles are traveling in the second transport star. The number of pivoting arms can be equal to or less than the number of accommodations in the transport star, which equals the number of pressure-application elements, whether or not the pivots 64 of the pivoting arms are on a circle that is concentric with the orbit of the pressure-application elements or on one that is concentric with that of the accommodations in the second transport star.

The pivoting arms are guided by a contour 68 on a guide plate 69 in the bearing housing 45. The contoured guide 71 for the pivoting arms is independent of the system that guides the pressure-application elements.

Some preferred embodiments of the invention will now be described with reference to the accompanying drawings, wherein

DETAILED DESCRIPTION OF THE PREFERRED EMBODIMENTS

Figure 1:
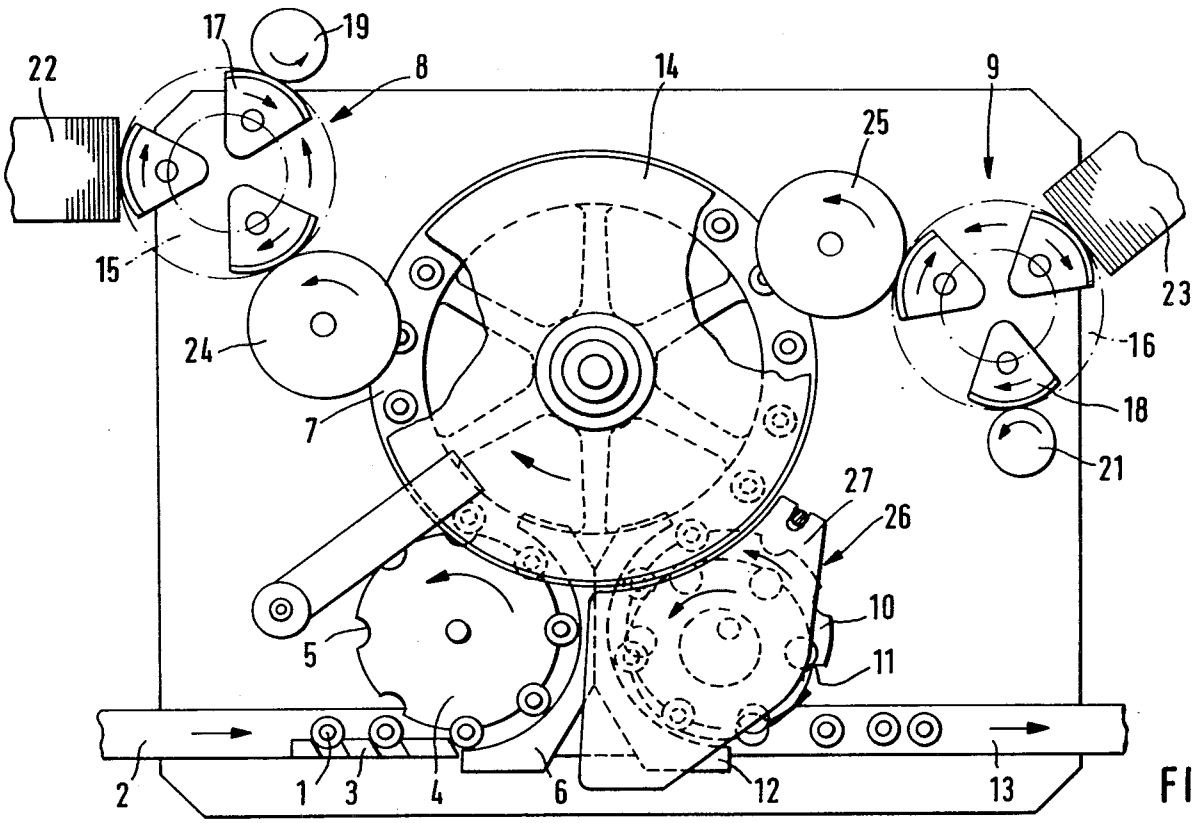
FIG. 1 is a top view of a labeling machine with two labeling stations.

The labeling machine illustrated in FIG. 1 consists essentially of a plate conveyor 2 that advances the bottles 1 being labeled and foiled, of a separation worm 3 that distributes the bottles at intervals corresponding to the sequence of the downstream means of conveyance, of an initial transport star 4 with pocket-like accommodations 5 distributed around its circumference and in which the bottles are maintained by a stationary arc-shaped guide 6, of a turntable 7 that conveys the bottles in its accommodations past two labeling stations 8 and 9 and to another transport star 10 with pocket-shaped accommodations 11 distributed around its circumference and with another arc-shaped guide 12 associated with the accommodations, and of a conveyor belt 13 that carries the labeled and foiled bottles away.

Each accommodation in turntable 7 has a rotating mechanism with a rotationally controlled rotating plate and a plunger that moves up and down, none of these devices being illustrated. The accommodated bottle is tensioned between the rotating plate and the rotating plunger. The rotational controls of the plate rotates the bottle as it travels into various angles, at which a front label, a blank of foil, and a rear label can be transferred to it. The rotational controls also positioned the bottles at the correct angle for being processed by label-application mechanisms, brushes for example, downstream of labeling stations 8 and 9 and not illustrated.

A hood 14, illustrated as partly broken in the vicinity of labeling stations 8 and 9, is positioned above turntable 7. Both first labeling stations have essentially the same design and consist of a rotating support 15 or 16 carrying pickups 17 and 18 that rotate in opposite directions and, once their surfaces have been supplied with adhesive from rotating adhesive rollers 19 and 21, pick up labels from a stack 22 or 23 and transfer them to rotating gripper cylinders 24,25 that apply them with their adhesive side to bottles 1. Since the pickups 17 in first labeling station 8 are in two parts, they can process a belly label and a foil blank simultaneously, whereas the pickups 18 in second labeling station 9 are in one piece and can only handle a rear label.

Figure 2:
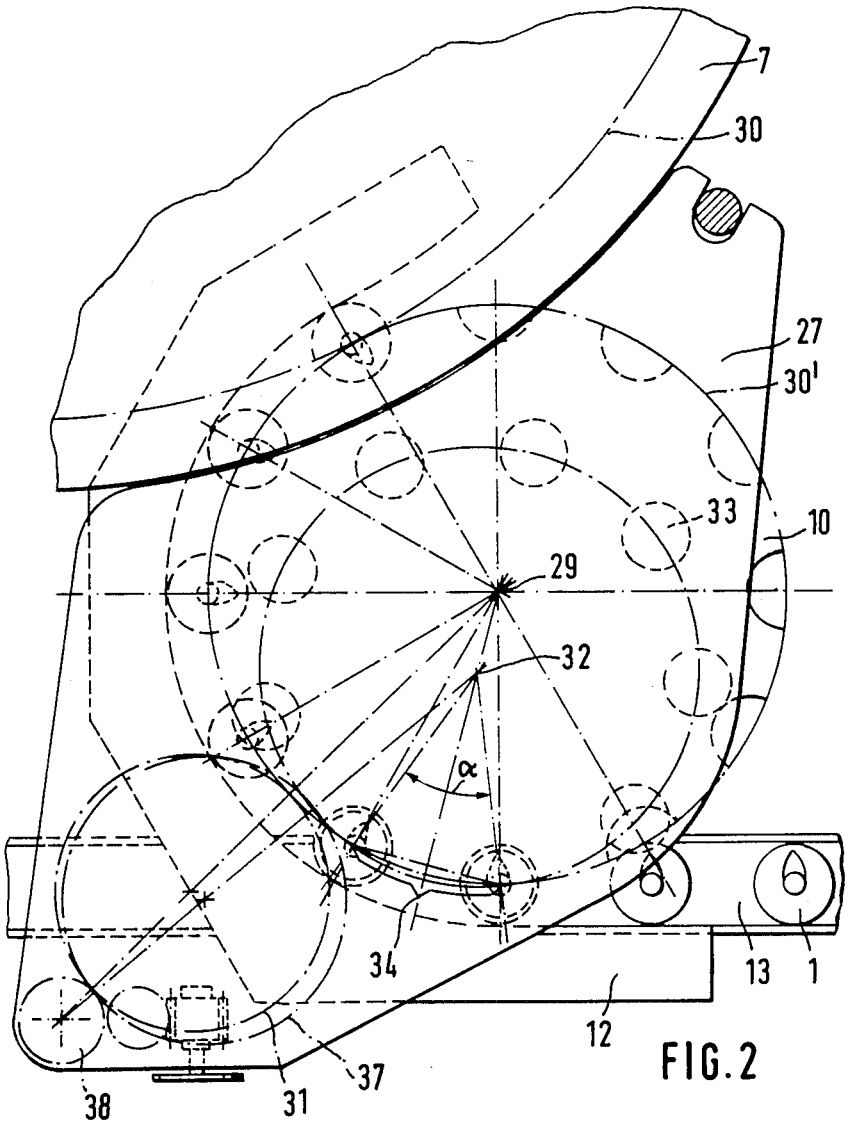
FIG. 2 is an enlarged detail of the machine in FIG. 1, specifically of the second transport star and of the supporting stand, as viewed from above.
Figure 3:
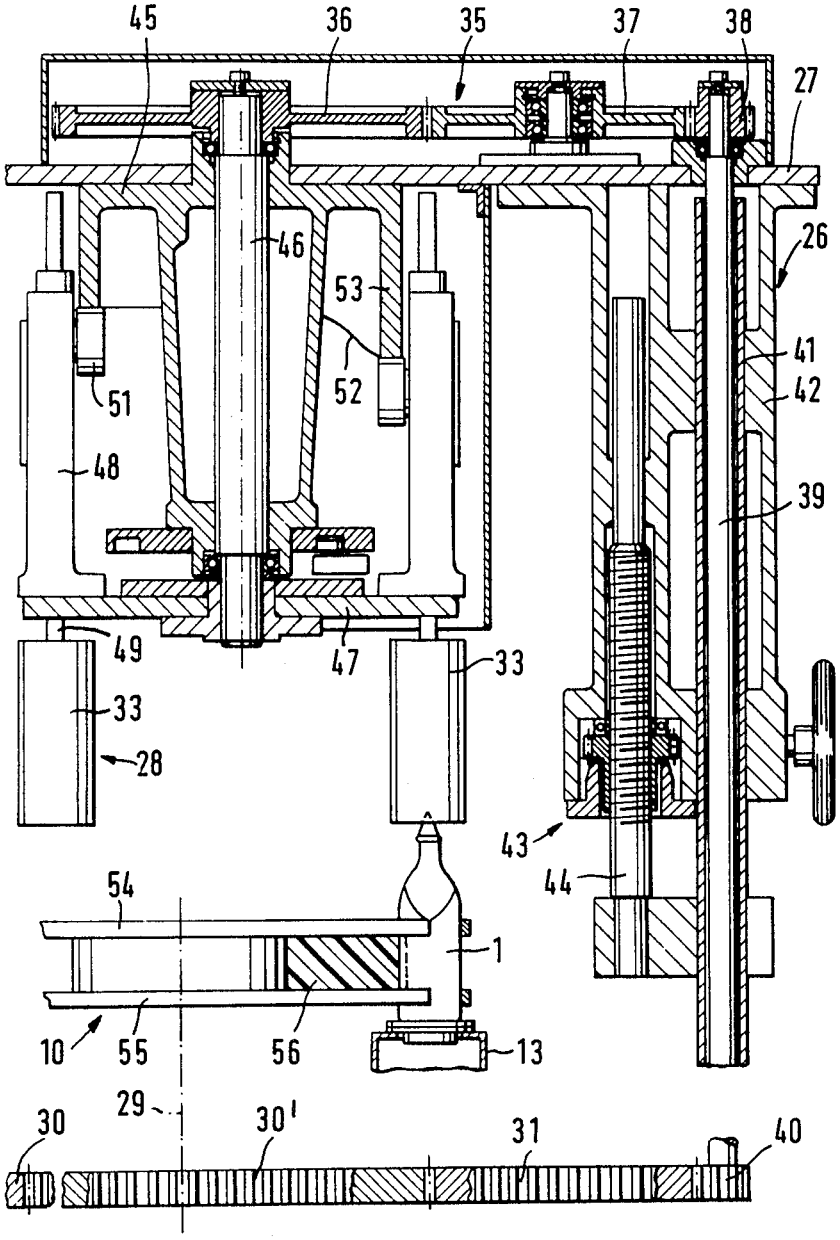
FIG. 3 is a vertical section through the supporting stand and the second transport star.

A supporting stand 26 positioned at second transport star 10 has an essentially horizontal supporting plate 27. As will be evident from FIGS. 2 and 3, a folding and pressure device 28 is positioned along with second transport star 10 below the supporting plate 27 on supporting stand 26. Transport star 10 is rotated around an axis 29 by cogwheels 30 and 30', represented only schematically in FIG. 2, whereas folding and pressure device 28 is rotated around an axis 32. Axes 29 and 32 of rotation are, as will be evident from FIG. 2, mutually eccentric. The radial distances of the accommodations 11 in second transport star 10 to their axes 29 of rotation and the radial distances of pressure-application elements 33, which also function as folding elements in a way that will be described in greater detail hereinafter, to their axis 32 of rotation are selected such that the orbits of the accommodations 11 in second transport star 10 and of pressureapplication elements 33 extensively coincide over a specific segment 34. This common segment 34 is located in the vicinity of conveyor belt 13 and extends over an angle $\alpha$. The blanks of foil are applied to the bottles within segment 34 in a way that will be explained in greater detail hereinafter. The number of pressure-application elements 33 in the embodiment illustrated in FIGS. 2 and 3 is lower than that of the accommodations 11 in second transport star 10. Thus, the transport star has twelve accommodations and there are only nine pressure-application elements. The elements are disposed in such a way as to keep pressure-application elements 33 out of the vicinity of turntable 7 or of its centering hood 14, preventing collisions at that point.

Folding and pressure device 28 is driven with a reversing gear train 35 that comprises cogwheels 36, 37, and 38 Connected to a driveshaft 39 an another cogwheel 40 that engages cogwheel 30' through an intermediate cogwheel 31. Driveshaft 39 extends through the bearing bush 41 of a housing flange 42 that is rigidly attached to the supporting plate 27 of supporting stand 26. Housing flange 42 accommodates a level adjustor 43 that is employed in conjunction with a threaded spindle 44 to adjust the overall supporting stand vertically and adapt it to bottles of different sizes.

A bearing housing 45 is fastened to the side of supporting plate 27 that faces away from cogwheels 36, 37, and 38. A bearing shaft 46 rotates in bearing housing 45. A retainer plate 47 is rigidly attached to the lower end of bearing shaft 46. The pressure-application elements 33, which are in the form of heads, extend along one side of retainer plate 47 and sleeves 48 along its other side. Drag rods 49 for pressure-application elements 33 slide up and down in sleeves 48 against the force of springs, which are not illustrated. Excess-pressure springs can be installed in sleeves 48 to secure the system. Drag rods 49, which are coaxial with pressure-application elements 33, move up and down on lateral support rollers 51 in conjunction with a contour 52 on the pot-shaped walls 53 of bearing housing 45.

Second transport star 10, which is driven independent of folding and pressure device 28, consists of two plates 54 and 55 made out of polyurethane foam and of an intermediate ring 56 of elastic material that extends partly into the pocket-shaped accommodations 11 and can be compressed by the bottles 1 transferred into them. Bottles 1 are secured in accommodations 11 by an arc-shaped guide 12, which is equipped with sliding strips, not illustrated. The coefficients of friction of the surface of ring 56 that comes into contact with bottles 1 and the coefficient of friction of the sliding strips are selected such that there is a high level of friction between a bottle 1 and the surface of ring 56 and a low level of friction between the bottle and the sliding strips. Thus, bottles 1 will not rotate in accommodations 11 as they are transported by transport star 10.

The operation of the labeling machine illustrated in FIGS. 1 through 3 will now be described.

Bottles 1 supplied by plate conveyor 2 are individually separated at the proper interval by separation worm 3, taken over by first transport star 4, and transferred to the accommodations in turntable 7. The rotating plates and plungers secure the bottles at a specific angle as they are transported past first labeling station 8 such that a belly label and a blank of foil with one corner down and another corner extending beyond the head of the bottle can be applied centrally to each bottle. The bottles are then rotated by the rotational controls on the rotating plate and advanced past application-device label-smoothing mechanisms, not illustrated, positioned stationary along the path of transport. The bottles then arrive at second labeling station 9, where they are rotated into a position with the rear facing the station. The rear label can be applied at this angle. As the bottles continue to advance, they are rotated into a position in which the smoothing mechanisms, also not illustrated, for the rear label can be completely applied and in which the corners of the blank of foil point upstream. This position is indicated in the figures by the upstream corners.

The bottles, once they have been supplied with labels and blanks as just described, are taken over in the vicinity of second transport star 10 by the accommodations 11 in the star and transported on between the accommodations and arc-shaped guide 12 without being rotated. During this stretch, finally, one pressure-application element 33 always enters the vicinity of one accommodation 11 at a time, so that, as the element descends, it wraps down the corner of the blank that projects up beyond the head of the bottle. As the bottles continue to travel, pressure-application element 33 and accommodation 11 arrive in common segment 34, where the previously wrapped end of the foil can be rolled against the head of the bottle. Once the bottle is completely foiled, at the end of segment 34, the pressure-application head is raised again and the bottle is ready to leave second transport star 10 on conveyor belt 13.

Figure 4:
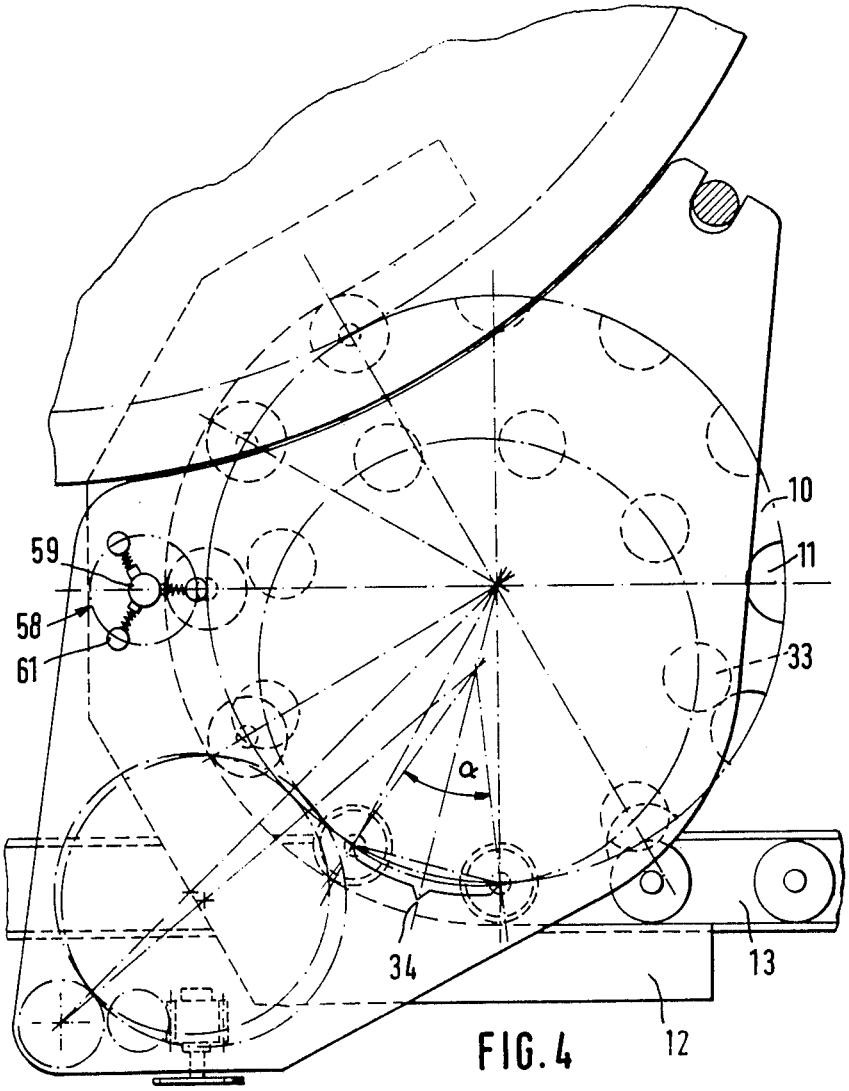
FIG. 4 is a view similar to that in FIG. 2 of the transport star and supporting stand along with a prefolder.
Figure 5:
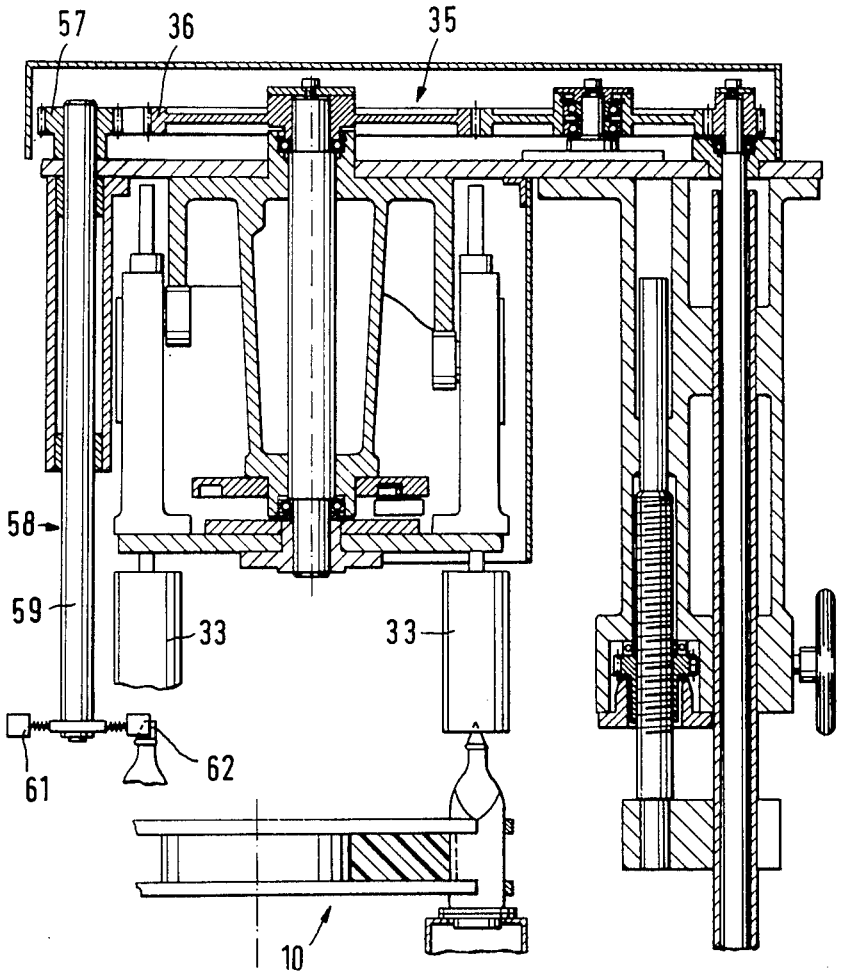
FIG. 5 is a vertical section through the mechanisms in FIG. 4.

If a bottle 1 is to be provided with a round blank of foil, which accordingly demands both preliminary and final folding in, the embodiment illustrated in FIGS. 4 and 5 is appropriate. This equipment corresponds extensively to the embodiment illustrated in FIGS. 1 through 3 except that a preliminary folder 58 is driven by the cogwheel 36 in reversing gear train 35 through a cogwheel 57. Preliminary folder 58 comprises a shaft 59 connected to cogwheel 57 and, positioned radially on the shaft, preliminary-folding components 61 that, as they revolve, fold in one side of the end 62 of the blank that extends up like a sleeve beyond the head of the bottle. The section 62 that extends up is then wrapped as in the embodiment described with reference to FIGS. 1 through 3 by the lower surface of a pressure-application element 33, whih then finally also, subsequent to further travel, presses the blank against the head of the bottle in common segment 34.

Figure 6:
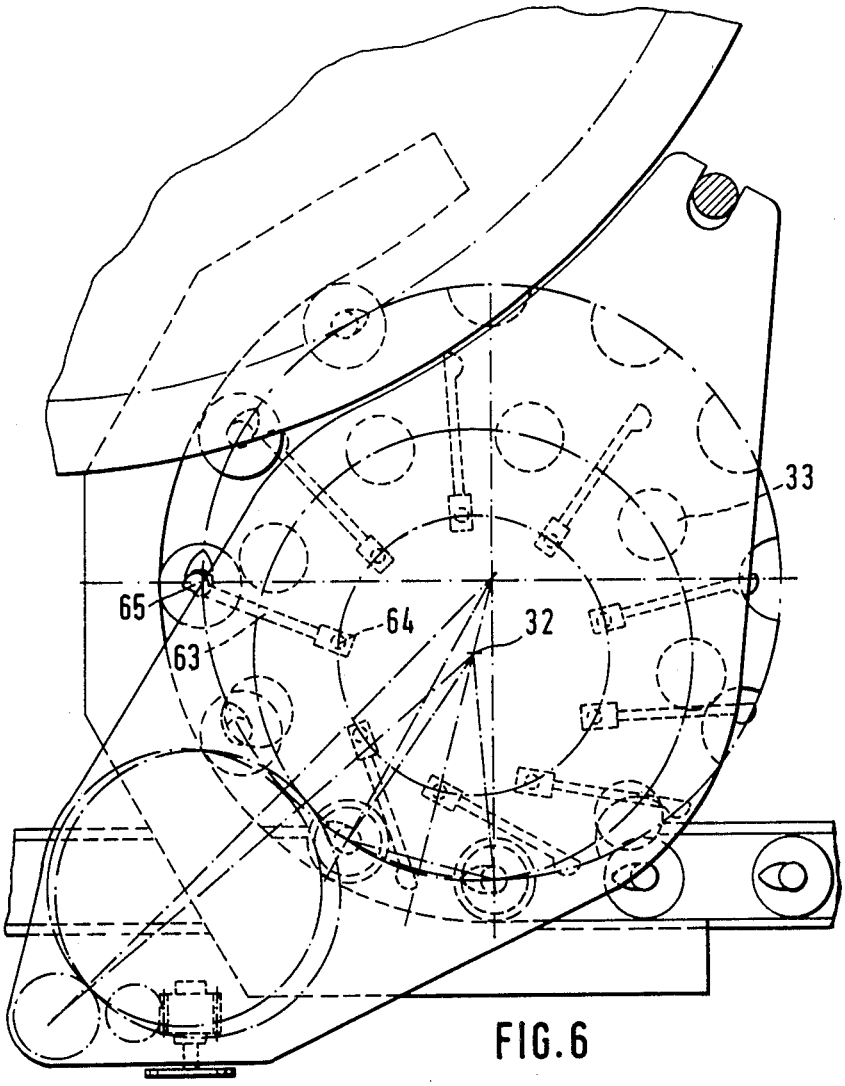
FIG. 6 is a top view of another embodiment of the folding and pressure device with additional folding mechanisms.
Figure 7:
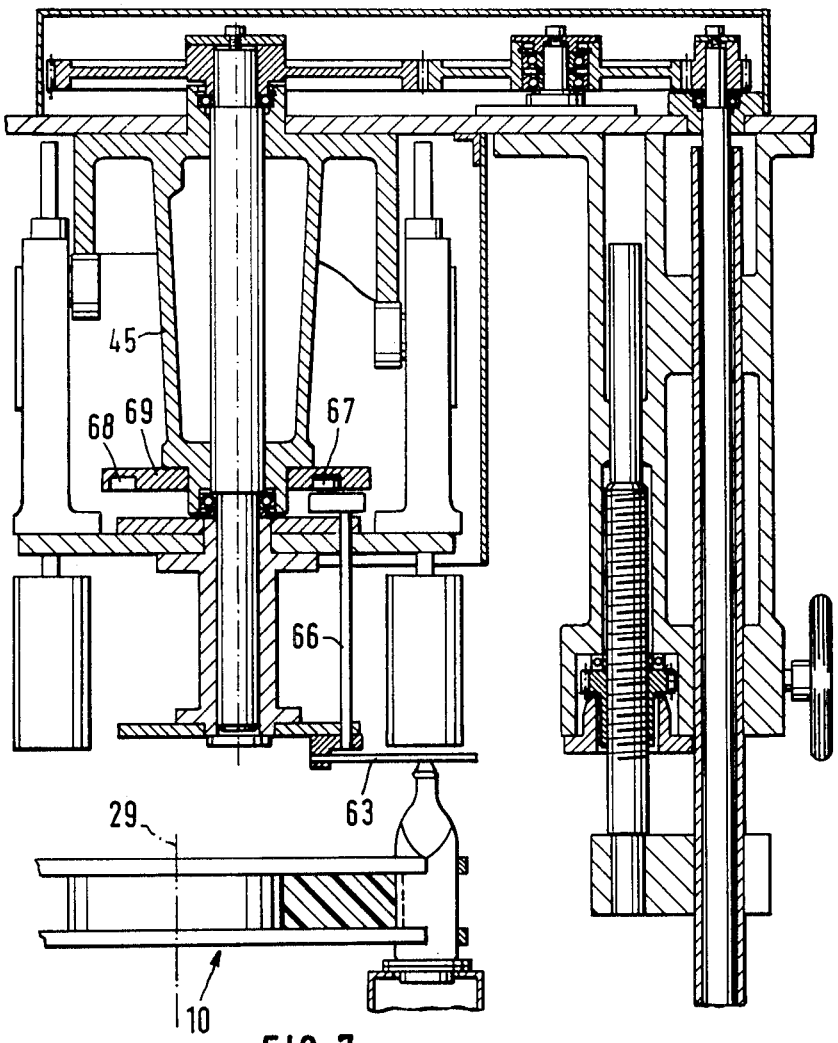
FIG. 7 is a vertical section through the mechanisms in FIG. 6.

The pressure-application elements 33 and folding elements in the embodiment illustrated in FIGS. 6 and 7 are separate. The folding elements consist of pivoting arms 63 with pivots 64 positioned along a circle that is concentric with axis 32 of rotation. Pivoting arms 63, which have a nose 65, can be employed to wrap down a blank corner that extends beyond the head of the bottle as well as for preliminary and final folding, depending on how the arms are controlled. FIG. 7 illustrates controls for pivoting arms 63 in which a guide 67 engages a contour 68 in a guide plate 69 mounted on bearing housing 45 through a vertical guide rod 66. These controls can be designed such that, as illustrated in FIG. 6, nose 65 carries out the preliminary folding and the opposite flat side of a pivoting arm 63 carries out the final folding, with the arm appropriately traveling faster than the bottle, upstream of the arm, through second transport star 10. The foil is then pressed down in segment 34 as previously described herein. The number of pivoting arms 63 in the embodiment illustrated in FIGS. 6 and 7 equals the number of pressure-application elements 33.

Figure 8:
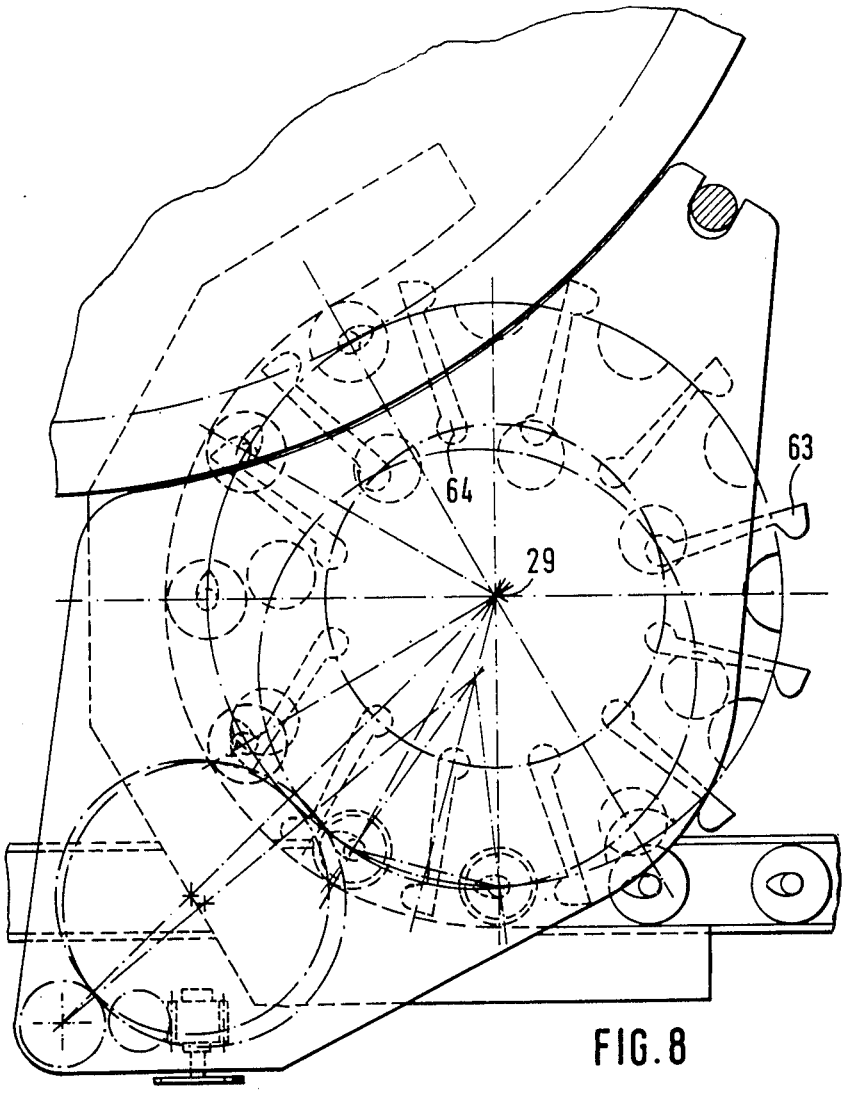
FIG. 8 is a top view of another embodiment with folding elements that are driven independently of the pressure-application elements.
Figure 9:
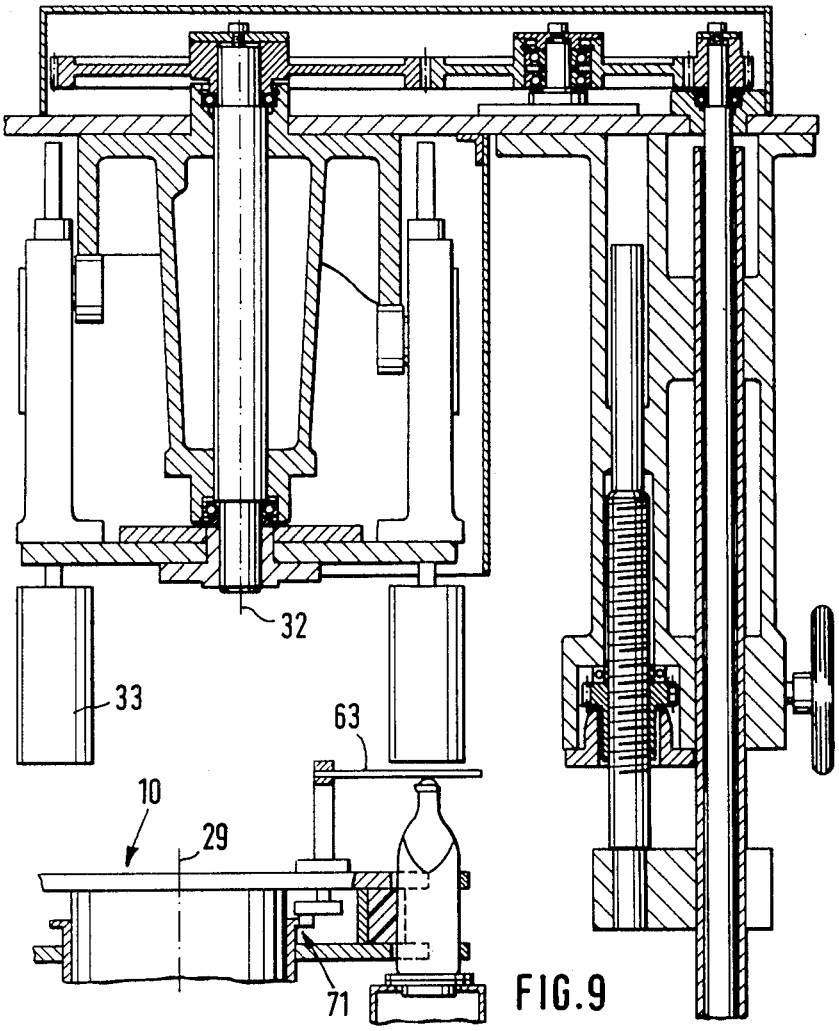
FIG. 9 is a vertical section through the mechanisms in FIG. 8.

To prevent any sliding motions between pivoting arms 63 and the blanks or bottles, the number of pivoting arms 63 can also equal the number of accommodations 11 in second transport star 10. FIGS. 8 and 9 illustrate an embodiment of this type. The pivots 64 of pivoting arms 63 are positioned in a circle that is concentric with axis 29 of rotation. Another difference with respect to the embodiment illustrated in FIGS. 6 and 7 is that the arms are not contour-controlled from above through folding and pressure device 28 but from below, from the vicinity of transport star 10. There is a contoured guide 71 for this purpose.

Figure 10:
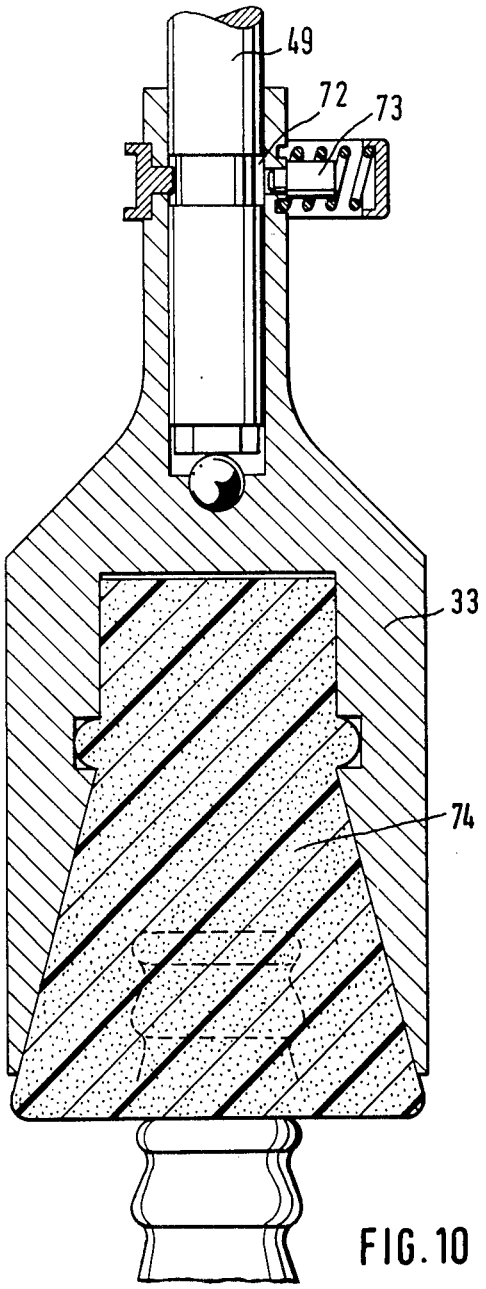
FIG. 10 is a magnified view of a pressure-application element.

FIG. 10 illustrates one embodiment of a pressure-application element 33. Drag rod 49 has an annular groove 72 that can be employed in conjunction with a triggering pin 73 to establish a connection to pressure-application element 33. The space inside the pressure-application element is lined with foam rubber 74 in such a way that the head of the bottle will be gripped all around, allowing satisfactory application of the foil.

It will be understood that the specification and examples are illustrative but not limitative of the present invention and that other embodiments within the spirit and scope of the invention will suggest themselves to those skilled in the art.

I claim:

1. In an apparatus for applying a blank of foil to bottles and that includes a turntable with a plurality of separately controlled devices around its circumference for rotating the bottles, at least one labeling station for transferring the foil blanks to the bottles once the rotation devices have positioned the bottles at a specific angle, an application device that presses the blanks onto the bottles, a rotating output transport star that has accommodations for the bottles and is positioned downstream of the turntable and upstream of a conveyor belt that carries the bottles away, and a supporting stand that is positioned in the vicinity of the output transport star and has a rotating transfer-and-application device comprising a plurality of similar units distributed around its circumference with pressure-application elements that fold and press down the ends of the blank extending beyond the head of each bottle, the improvement which comprises positioning the pressure-application elements so that as they revolve they are kept outside the circumference of the circle defined by the devices on the turntable that accommodate the bottles.

2. An apparatus according to claim 1, wherein the axis of rotation of the pressure-application elements and the axis of rotation of the output transport star are mutually eccentric.

3. An apparatus according to claim 1, wherein the amount of eccentricity between the axis of rotation of the output transport star and the axis of rotation of the pressure-application elements and the radial distances of the accommodations in the output transport star from their axis of rotation and of the pressure-application elements from their axis of rotation are such as to ensure that the orbits of the accommodations and of the pressure-application elements extensively coincide along one segment.

4. An apparatus according to claim 3, wherein the one segment of the orbits is located in the vicinity of the conveyor belt that carries the bottles away, whereby since the interval between adjacent pocket-shaped accommodations in the output transport star and between adjacent pressure-application elements is always identical, peripheral speeds will always be identical within the segment.

5. An apparatus according to claim 1, wherein the number of pressure-application elements is lower than that of the accommodations in the output transport star.

6. An apparatus according to claim 1, including a mechanism that drives the pressure-application elements and a mechanism that drives the output transport star, the two drive mechanisms being separate.

7. An apparatus according to claim 6, wherein the mechanism that drives the presure-application elements is a reversing gear train alongside the output transport star.

8. An apparatus according to claim 7, wherein the reversing gear train has a driveshaft that extends through a housing flange on the supporting stand and mutually meshing cogwheels mounted on a supporting plate that extends over the output transport star.

9. An apparatus according to claim 8, wherein the housing flange has a level adjustor to control the height of the supporting stand.

10. An apparatus according to claim 8, wherein a bearing housing is mounted concentric to the axis of rotation of the transfer and application device on the side of the supporting plate that faces away from the cogwheels, the bearing housing accommodating a bearing shaft that secures a retainer plate on which the pressure-application elements are mounted.

11. An apparatus according to claim 10, wherein the pressure-application elements are mounted on the side of the retainer plate that faces the output transport star, the apparatus further including sleeves mounted on the side of the retainer plate that faces the supporting plate, and spring-loaded drag rods for the pressure-application elements arranged so as to be slidable up and down inside the sleeves.

12. An apparatus according to claim 11, wherein the axes of the drag rods coincide with the axes of the pressure-application elements.

13. An apparatus according to claim 11, further including support rollers mounted in the sleeves, the support rollers projecting out laterally and operating in conjunction with a contour on a pot-shaped wall of the bearing housing in order to move the pressure-application elements vertically.

14. An apparatus according to claim 10, including folding elements having preliminary-folding components, the preliminary-folding components being positioned radially around a common shaft that meshes through a cogwheel with the cogwheel in the reversing gear train that drives the bearing shaft.

15. An apparatus according to claim 14, wherein the folding elements are pivoting arms guided by a contour system.

16. An apparatus according to claim 15, wherein the contour system is designed in such a way that the pivoting arms, which are equipped with a nose, also function as preliminary and final folding mechanisms.

17. An apparatus according to claim 16, wherein the pivoting arms are guided by a contour on a guide plate in the bearing housing.

18. An apparatus according to claim 17, wherein the pivots of the pivoting arms are on a circle that is concentric with the orbit of the pressure-application elements and the number of pivoting arms is greater than the number of pressure-application elements.

19. An apparatus according to claim 15, wherein the contoured guide for the pivoting arms is independent of the system that guides the pressure-application elements.

20. An apparatus according to claim 19, wherein the pivots of the pivoting arms are on a circle that is concentric with that of the accommodations in the output transport star.

21. An apparatus according to claim 1, wherein the pressure-application elements are also folding elements.

22. An apparatus according to claim 1, further including folding elements.

23. An apparatus according to claim 22, wherein the folding elements have preliminary-folding components.

* * * * *